United States Patent [19]

Karolyi

[11] 4,008,887

[45] Feb. 22, 1977

[54] APPARATUS AND METHOD FOR THE FOLDING OF MATERIAL TO BE PACKAGED

[75] Inventor: Oskar Karolyi, Boll, Germany

[73] Assignees: Fritz Stahlecker; Hans Stahlecker, both of Germany

[22] Filed: Feb. 11, 1974

[21] Appl. No.: 441,320

[30] Foreign Application Priority Data

Feb. 10, 1973 Germany ..... 2306653

[52] U.S. Cl. ..... 270/61 R

[51] Int. Cl.[2] ..... B65H 45/00

[58] Field of Search ..... 270/61, 61 F, 84, 81, 270/80, 16, 41, 42; 223/37, 38; 270/66, 69, 62

[56] References Cited

UNITED STATES PATENTS

| | | | |
|---|---|---|---|
| 1,222,459 | 4/1917 | Phillippie | 270/61 |
| 3,148,807 | 12/1964 | Freeman | 223/37 |
| 3,167,223 | 1/1965 | Weiss | 223/37 |

*Primary Examiner*—Robert W. Michell
*Assistant Examiner*—V. Millin
*Attorney, Agent, or Firm*—Craig & Antonelli

[57] ABSTRACT

Apparatus and method for folding material, particularly bulky textile material and the like which is to be packaged. A plurality of pivotal folding flap plates are provided for sequentially applying folds to the material. In order to prevent unfolding or undesired shifting of the material during the folding operation, gripping devices are provided at several of the movable folding plates, which gripping devices are movable between a position gripping the material against the respective folding plate and a non-gripping position. In a preferred embodiment of the invention, the gripping members are constructed as C-shaped fingerlike elastic elements mounted on rotatable gripper shafts, which gripper shafts are connected to rotatable flexible shafts and a control mechanism for sequentially controlling the rotation of the flexible shaft. A cam, lever, and gear arrangement is provided for rotating the flexible shaft in a preferred embodiment of the invention. The method of the invention includes gripping the material against the plates during the folding operations.

24 Claims, 13 Drawing Figures

APPARATUS AND METHOD FOR THE FOLDING OF MATERIAL TO BE PACKAGED

BACKGROUND AND SUMMARY OF THE INVENTION

This invention relates to an apparatus and method for the folding of material to be packaged, particularly textiles, wherein folding elements are provided in the form of flat plates on which the textiles are placed at least partially and are then folded together by pivotal motions of movable folding flaps.

Folding elements of this type are known in practice. They serve the purpose of folding or laying together a material to be packaged, especially textiles, spread out partially on a stationary plate support and also partially or entirely on a support consisting of movable folding flaps, by means of a pivotal motion of the folding flaps of, for example, 180°. Such folding flaps fulfill their purpose entirely satisfactorily, if readily foldable packaging material is involved, which primarily has the same thickness and material characteristics over-all. In case of bulky textiles, however, or textiles which contain rubber bands and the like extending therethrough, the folded condition is not retained with certainty; rather, the material to be packaged has the tendency to reassume its original, unfolded shape or at least an unintended arbitrary shape after the folding flaps have been removed, especially during a subsequent operating step.

It has also been disclosed (DOS [German Unexamined Published Application] 1,560,143) to execute, in connection with a textile material, pivotal motions by means of conveyor bars and simultaneously to clamp the conveyed material into position by means of a supporting pressure roll. This device, intended exclusively for conveying purposes, can not be utilized for the substantially more difficult operation of folding and laying a textile product, since the material is held only very unsatisfactorily.

It has furthermore been disclosed (DOS 1,955,060) to provide, in a folding process for stockings, rotatably mounted and comb-shaped plates on which the material to be folded is wound onto cardboard panels and thus folded; the cardboard panels and a portion of the piece of goods are clamped between the movably fashioned fingers of the comb-like plates and firmly held prior to the winding step. These devices have the disadvantage that a central folding together or lateral parts of the textile products is impossible, as is required, for example, in case of underwear, tricot goods, or the like.

Therefore, this invention contemplates providing an apparatus with pivotable folding flaps of the type mentioned hereinabove, which apparatus holds the material to be folded securely, especially also with a high folding speed, in every phase of the motion and is, therefore, also usable for textile goods which are hard to fold and which have an elastic structure. The present invention also contemplates a method of folding material while holding the material securely during certain of the folding steps.

The present invention further contemplates providing apparatus with controlled grippers mounted to the folding flaps for holding the material to be packaged during folding operations.

These controlled grippers makes it possible to hold the material to be packaged securely at the folding flaps during the folding step and to fix the material in the desired shape also after termination of the folding procedure. Therefore, any unintended arbitrary movements of the material to be packaged or any subsequent unfolding are effectively prevented.

According to preferred embodiments of the invention, these grippers attached to the folding flaps are operable either during the entire folding process or also during limited periods of time. An advantageous feature of a preferred embodiment of the invention provides that the grippers open prematurely shortly prior to termination of a folding step and thus become inoperative in order to make room for another operating member to carry out the next folding step or the like. In preferred embodiments, the grippers are articulated to a shaft extended along the folding flaps, which shaft, in turn, is controlled via a Bowden wire mechanically by way of cam disks. In other contemplated embodiments, the shaft is controlled electrically, electromagnetically, pneumatically, or hydraulically. The grippers proper are preferably resilient and curved in the form of fingers and mounted so that they do not collide with other grippers or with any folding flaps.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
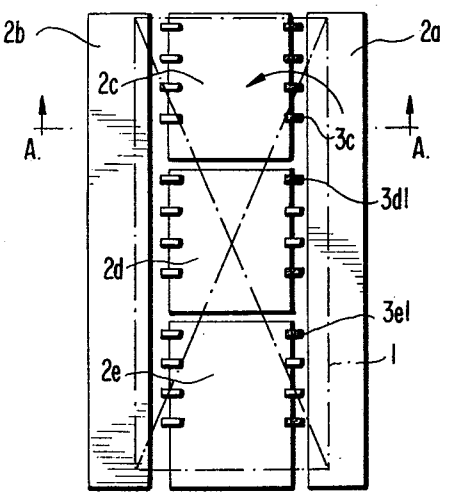
FIG. 1 is a top schematic view of folding apparatus constructed in accordance with the present invention and in a position with none of the folding flaps actuated.

In the figures, the textile material to be packaged bears reference numeral 1 and the folding flaps, five in total, are denoted by reference numerals 2*a* through 2*e*. The subscript letters *a*, *b*, *c*, *d*, *e* refer respectively to the corresponding folding flap to depict the respective folding flap as well as the grippers and the mounting thereof associated with the respective folding flap. The material to be packaged, denoted by 1, is shown in dot-dash lines and, in the top views, also bears diagonal lines for the sake of clarity.

Figure 4:
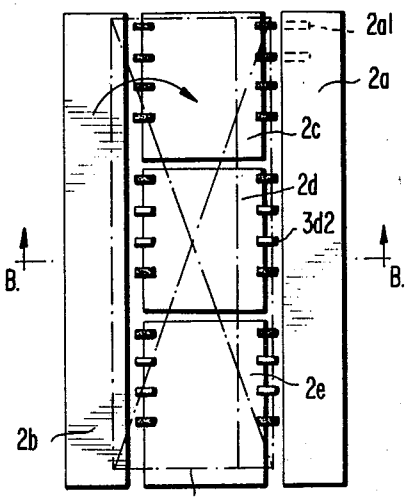
FIG. 4 is a top schematic view of the folding apparatus of FIG. 1 depicting the position of folding flaps and grippers after completion of the first longitudinal folding step.
Figure 5:
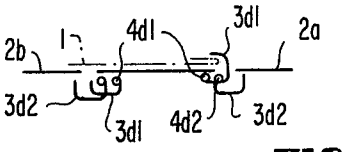
FIG. 5 is a schematic cross sectional view along line B—B of FIG. 4 depicting completion of the first longitudinal folding step.
Figure 12:
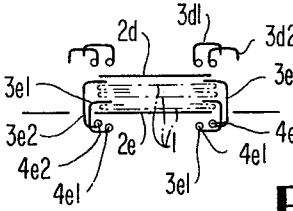
FIG. 12 is a schematic cross sectional view along line E—E of FIG. 10 depicting operation of the folding flap 2*d.

The grippers, each bearing the numeral 3 and additional appropriate subscript letters (to depict flaps they are associated with), are preferably provided only on those folding flaps which serve for transverse folding, i.e. on the folding flaps 2*c*, 2*d*, and 2*e*. It is, of course, also contemplated by the invention to mount grippers to the flaps 2*a* and 2*b* serving for the longitudinal folding steps, in instances where such would be desired because of the particular packaging material, for example if the material to be packaged is fed in already prefolded form, or in order to render the first longitudinal folding step even more secure. The grippers are mounted on rotatably disposed shafts extended along the transverse folding flaps, wherein the folding flap 2*c* has a shaft 4*c* on each longitudinally extending side (FIG. 2), while the folding flap 2*d* has two shafts 4*d*1 and 4*d*2 on each of its respective longitudinally extending sides (FIG. 5), and the folding flap 2*e* also has two shafts 4*e*1 and 4*e*2 on each of its respective longitudinally extending sides (FIG. 12). Correspondingly, the grippers 3*c* are provided at the folding flap 2*c*, the grippers 3*d*1 and 3*d*2 are mounted to the folding flap 2*d*, and the grippers 3*e*1 and 3*e*2 are arranged at the folding flap 2*e*. Recesses 2*a*1, two of which are (other not illustrated for clarity of illustration of other features) in the right-hand upper corner of FIG. 4, are provided at the folding flaps 2*a* and 2*b*, through which the grippers can extend.

Figure 2:
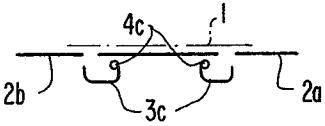
FIG. 2 is a schematic cross sectional view along line A—A of FIG. 1 depicting all folding flaps in non-actuated positions.

FIGS. 1 and 2 show the initial position of the folding apparatus before the folding flaps are actuated. The material 1 to be packaged lies spread-out on the folding apparatus. For the sake of simplicity of illustration, a rectangular shape of the packaging material is shown. However, the material can also have a different basic contour, especially if underwear, sport jackets, tricot wear, pullovers, etc. are involved. At this point, no gripper is as yet in operation.

It was found to be suitable and preferable, in accordance with the invention, to fashion the grippers to be curved in finger shape, in adaptation to the folding radius of the material to be packaged. Moreover, the grippers are elastic, due to the material of which they are made and due to their external dimensions, so that they can be resiliently deformed when a load is applied and thus are neither damaged themselves nor can they damage the material to be packaged. The grippers preferably consist of spring plates or of reinforced or not reinforced synthetic resins with or without a spring core insert. Since rigid grippers are not capable in every case of releasing the material to be packaged during several successive folding steps, the above-described resilient grippers are preferred. However, the present invention also encompasses arrangements with rigid grippers.

Figure 3:
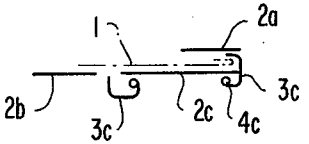
FIG. 3 is a schematic cross sectional view along line A—A of FIG. 1 depicting actuation of the folding flap 2*a;*

The actual folding procedure starts with the pivoting of the folding flap 2*a* by 180° from the initial position shown in FIG. 2 into the position illustrated in FIG. 3. The pivot axles of the individual folding flaps are not shown in the figures, since they may be of conventional construction and illustration thereof would only make a clear showing of the gripper functions difficult. These pivot axles of the folding flaps will, of course, be positioned so as not to interfere with the grippers functions.

The gripper fingers are controlled via drive elements (shown schematically in FIG. 13) so that they rotate, during the pivotal motion of the folding flap 2*a*, namely only toward the end of the 180° pivotal movement, likewise about approximately 180°, for example around the shaft 4*c* (FIG. 3), and assume the position illustrated in FIG. 3. In addition to the grippers 3*c* shown in FIG. 3, all grippers of FIG. 1 shown in full lines (blacked out rectangles) are also in operation, i.e. four grippers 3*c*, two grippers 3*d*1, and two grippers 3*e*1. The grippers of FIG. 1 shown as empty rectangles remain out of operation during the pivotal movement of the folding flap 2*a*. Since the material to be packaged is held, after the first longitudinal folding step, by the grippers, the folding flap 2*a* can pivot back into its original starting position (FIG. 5) without risk of unfolding of the material. The material, to be packaged proper has, at this time, the contour configuration shown in FIG. 4.

Figure 6:
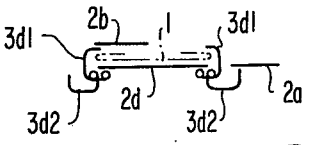
FIG. 6 is a schematic cross sectional view along line B—B of FIG. 4 depicting actuation of the folding flap 2*b;*
Figure 8:
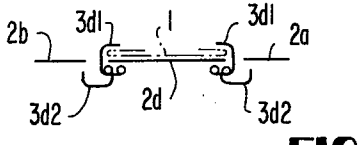
FIG. 8 is a schematic cross sectional view along line C—C of FIG. 7 depicting completion of the first and second longitudinal folding steps.

Now the second longitudinal folding of the material to be packaged is effected by means of the folding flap 2*b* (FIG. 6), wherein the grippers on the other side of the transverse folding flaps operate analogously as described above for the grippers at the side of flap 2*a*. After both longitudinal folding steps have been completed and the longitudinal folding flaps have been returned to their original position, the situation as indicated in FIG. 8 exists.

Figure 7:
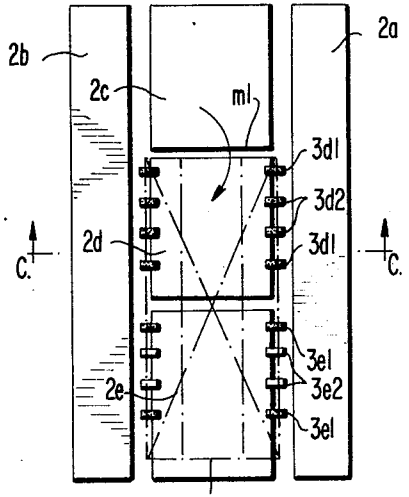
FIG. 7 is a top schematic view of the folding apparatus of FIG. 1 as it appears prior to and during the actuation of the folding flap 2*c;*
Figure 9:
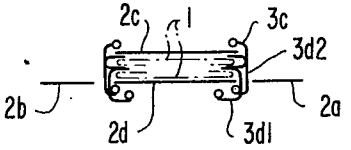
FIG. 9 is a schematic cross sectional view along line C—C of FIG. 7 depicting actuation of the folding flap 2*c;*

Following the two just-described longitudinal folding operations, the first transverse folding of the material to be packaged is accomplished by means of the folding flap 2*c* (FIG. 7). During this first transverse folding step, all grippers shown in full lines (blacked out rectangles) in FIG. 4 are initially in operation, so that the material to be packaged is held on the folding flaps 2*d* and 2*e* functioning as support at this time, as well as on the flap 2*c* which pivots about the axis ml (FIG. 7). Shortly before the termination of the 180° pivotal operation, the grippers 3*c* of the folding flap 2*c* again release the material to be packaged, since this flap 2*c*, after the folding operation, must pivot back into its original position together with the grippers 3*c* attached thereto. In place of the gripper 3*c*, the grippers 3*d*2 of shaft 4*d*2 become operative at this point in time, so that the situation illustrated in FIGS. 7 and 9 occurs shortly before the return of the folding flap 2*c*. Directly after the folding flap 2*c* has pivoted back into its initial position, the material to be packaged and the grippers are in the position shown in FIG. 11.

Figure 10:
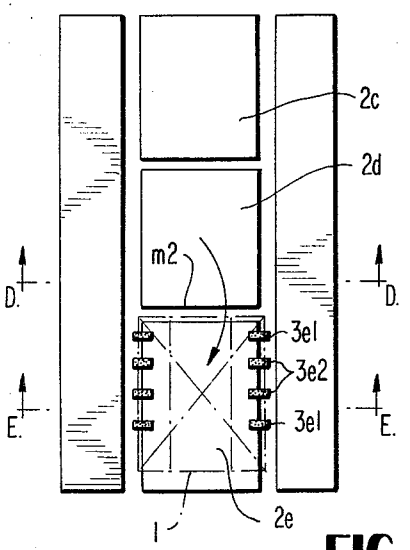
FIG. 10 is a top schematic view of the folding apparatus of FIG. 1 as it appears prior to and during the actuation of the folding flap 2*d;*
Figure 11:
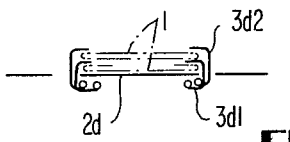
FIG. 11 is a schematic cross sectional view along line D—D of FIG. 10 depicting actuation of the folding flap 2*c;*

As can be seen from FIG. 11, the gripper fingers 3*d*1 are clamped between two folds, while the grippers 3*d*2 encompass both folds. After the subsequent transverse folding step by means of the folding flap 2*d*, which rotates about the axis *m*2, (FIG. 10), the grippers 3*d*1 must be removable from the material to be packaged, since the folding flap 2*d*, as previously the flap 2*c*, must be able to pivot back into its original position after the folding operation. For this reason, the gripper fingers of at least grippers 3*d*1 are preferably fashioned to be resilient to facilitate pulling them out of the folded material to be packaged. The folding step with the aid of the folding flap 2*d* takes place analogously to the folding operation by means of the flap 2*c*, so that the material and gripper positions as shown in FIGS. 10 and 12 result at the end of all folding steps.

The gripper fingers 3 are controlled as follows, in accordance with the schematic illustration of FIG. 13:

A main drive shaft 5 carries, for each gripper shaft 4, a cam disk 6 and, at a minor spacing therefrom, another cam disk 7 (indicated in dot-dash lines). One cam disk serves for pivoting the grippers in the clockwise direction, while the other serves for pivoting the grippers in the counterclockwise direction. The transmission of the pivotal motions takes place, starting with the cam disks, via levers 8 and 8*a*, respectively, a rotary lever 15, as well as a toothed segment 16 on which rotates, via a pinion 17, a flexible shaft 19 and thus a gripper shaft 4.

With a constant rotation of cam disks 6 and 7, respectively, in the direction of arrow s, rollers 9 and 10, respectively, attached to the levers 8 and 8*a*, respectively, roll along the top surface of the respective cam disk, namely the roller 9 travels along the cam disk 6 and the roller 10 along the cam disk 7. The two levers 8 and 8*a* are under the tension force of a spring 11 which effects a firm contact of the rollers on the cam disks. Both levers 8 and 8*a* are rotatably disposed about the fixed axle 12. After the roller 9 has reached, for example, the point 6*x* on the topside of the cam disk 6, the spring 11 pulls the lever 8 inwardly, whereupon this lever 8 can pivot, via a stop pin 13, a rotary lever 15 about the fixed axle 12. That is, stop pin 13 attached to lever 8 engages lever 15 to pivot lever 15 about axle 12. Toothed segment 16, since it is fixedly joined to the rotary lever 15, is pivoted in the direction *v*, whereby pinion 17 is rotated about a fixed axle 18 in the counterclockwise direction and likewise rotates the gripper shaft 4 attached to the folding flaps via the flexible shaft 19. The rotary lever 15 is pulled, by means of the spring 20 which is mounted, on the one hand, at 21 to the rotary lever and, on the other hand, at the fixed point 22, against the stationary abutment 23 and held in this position, after the lever 15 is initially rotated in the clockwise direction by stop pin 13 and lever 8. Once the roller 9, during the further rotation of the cam disk 6 in the direction *s*, has reached the point 6*y*, the lever 8 is again pivoted outwardly, and the stop pin 13 is likewise disengaged from the rotary lever 15 in the outward direction. However, the rotary lever 15 is still retained at the abutment 23 by the spring 20.

Since the cam disk 7 operates synchronously with the cam disk 6, although with a displaced cam recess, the roller 10 arrives at a somewhat later instant at the point 7*x* of the topside of the cam disk 7 and pivots the lever 8*a* inwardly due to the tensile force of the spring 11. Now the stop pin 14, attached to the lever 8*a*, moves the rotary lever 15 in the counterclockwise direction *u*, whereby the pinion 17 is rotated in the clockwise direction and transmits this rotation to the gripper shaft 4. The spring 20, in this case, presses the rotary lever 15 against a fixed abutment 24, so that the rotary lever is still held in this position once the roller 10 has passed the point 7*y* of the cam disk 7. Accordingly, the interplay of the levers 8 and 8*a* with a constantly rotating drive shaft 5 effects the respective pivotal motion of the grippers 3. The configuration of the cam disks 6 and 7 is adapted, in a manner not illustrated, to the motion requirements for the folding flaps 2*c*, 2*d*, 2*e*.

It is to be noted expressly that this mechanical control of the gripper fingers via cam disks, pendulum lever, rotary lever, and toothed segment with pinion is a preferred embodiment. It is also contemplated by the present invention to operate the flexible shaft 19 by some other type of control; suitable are control operations via rotary magnets which produce, triggered by impulse currents, a rotary motion in the clockwise direction and in the counterclockwise direction. Also hydraulic or pneumatic control elements are contemplated for producing a rotary motion to be exerted on the flexible shaft 19.

It is noted that spring 20 is an over-center or dead-center spring which biases rotary lever 15 in a given direction once lever 15 is moved in said direction beyond a central position with points 21 and 22 in alignment with axis of rotation 12.

Figure 13:
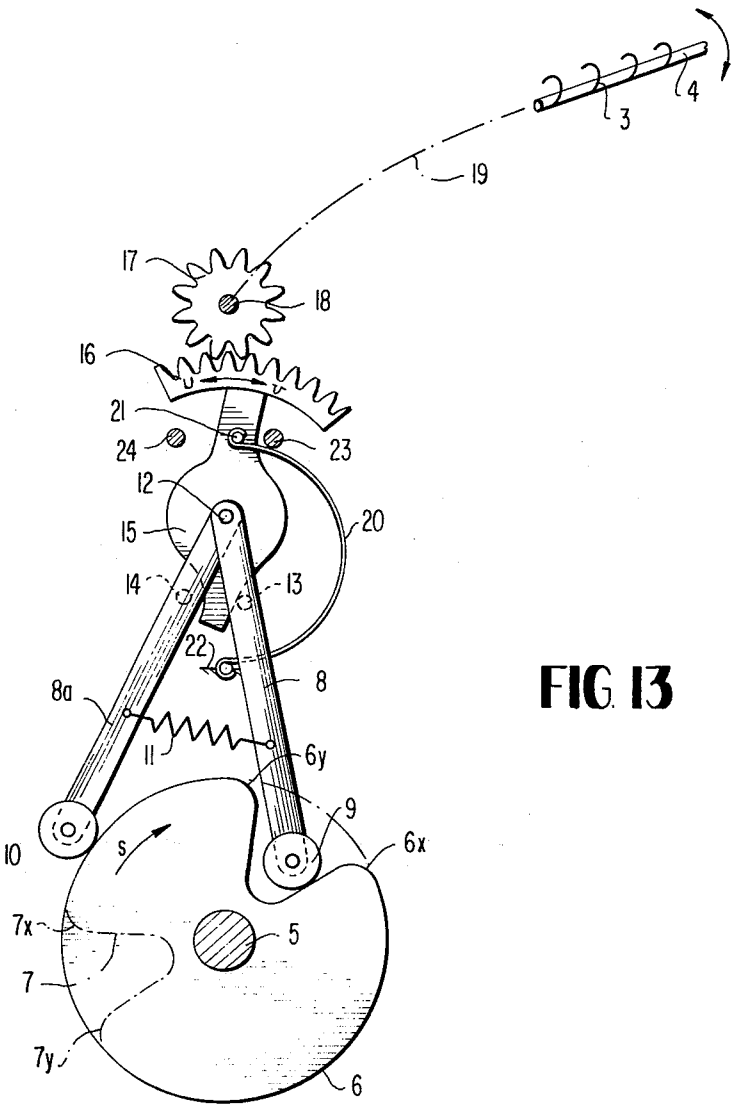
* and FIG. 13 is an enlarged schematic view of the drive for the folding flap grippers constructed in accordance with the present invention.

For the control of the motion of the folding flaps 2*c*, 2*d*, 2*e*, a cam operated adjusting apparatus such as illustrated in FIG. 13 for the grippers can be used. The cam disks for the folding flaps motion are arranged on a camshaft which rotates in synchronization with the cams 6 and 7 for the grippers so that the timing of folding flap and gripper operations are synchronized to carry out the folding and gripping steps described above.

The various grippers are disposed with gaps so as to prevent collisions with grippers associated with one of the other folding flaps during operation of the apparatus.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What I claim is:

1. Apparatus for folding material to be packaged comprising:

a plurality of folding flap means, folding flap moving means for sequentially moving said flap means to effect folding of material placed on said flap means, gripper means associated with at least one of said flap means, said gripper means being movable between a gripping position corresponding to gripping of material against a respective flap means and a non-gripping position, and gripper control means for controlling movement of said gripper means between said gripping and non-gripping positions during folding of material by said flap means and flap moving means, wherein said gripper means are attached to gripper support shafts, and wherein said gripper support shafts are attached to and movable with respective ones of said flap means, wherein said flap means includes:

a first transverse folding flap means for imparting a first transverse fold to material placed thereon, and additional transverse folding flap means for sequentially imparting at least one additional transverse fold to said material, wherein one of said gripper support shafts and associated gripper means is provided at each longitudinally extending edge of said first transverse folding flap means, and wherein two gripper support shafts and associated gripper means are provided at each longitudinally extending edge of each of said additional transverse folding flap means.

2. Apparatus for folding material according to claim 1, wherein said gripper control means includes means for moving each of said gripper support shafts independently of movement of other of said gripper support shafts.

3. Apparatus for folding material to be packaged comprising:

a plurality of folding flap means, folding flap moving means for sequentially moving said flap means to effect folding of material placed on said flap means, gripper means associated with at least one of said flapper means, said gripper means being movable between a gripping position corresponding to gripping of material against a respective flap means and a non-gripping position, said gripper means are attached to gripper support shafts, and said gripper support shafts are attached to and movable with respective ones of said flap means, and gripper control means for controlling movement of said gripper means between said gripping and non-gripping positions during folding of material by said flap means and flap moving means, said gripper control means including means for retaining said gripper means in a gripping position during folding movement of an associated flap means, whereby material being folded by said associated flap means is gripped against said associated flap means during folding movement of said associated flap means, and wherein said gripper control means further includes flexible shafts attached to and rotatable with each of said gripper support shafts.

4. Apparatus for folding material according to claim 3, wherein each of said flap means are constructed as pivotally movable flat plates.

5. Apparatus for folding material according to claim 3, wherein a plurality of said gripper means are provided for a corresponding plurality of said flap means, and wherein said gripper control means includes means for placing respective ones of said gripper means in a gripping position only during a portion of the folding sequence.

6. Apparatus for folding material according to claim 3, wherein said gripper means are resilient.

7. Apparatus for folding material according to claim 6, wherein said gripper means are curved in a C-shaped configuration in a finger-like manner.

8. Apparatus for folding material according to claim 3, wherein recesses are provided in the folding flap means along the edges thereof which face the respective axes of said gripper support shafts, through which recesses the gripper means can extend.

9. Apparatus for folding material to be packaged comprising:

a plurality of folding flap means including:

a plurality of transverse folding flap means for sequentially imparting transverse folds to material placed thereon, and longitudinal folding flap means at opposite longitudinal edges of said transverse folding flap means for imparting longitudinal folds to said material, and wherein gripper means are provided at opposite longitudinal edges of at least one of said transverse flap means, said gripper means being movable between a gripping position corresponding to gripping of material against a respective flap means and a non-gripping position, and gripper control means for controlling movement of said gripper means between said gripping and non-gripping positions during folding of material by said flap means and flap moving means, said gripper control means including means for retaining said gripper means in a gripping position during folding movement of an associated flap means, whereby material being folded by said associated flap means is gripped against said associated flap means during folding movement of said associated flap means.

10. Apparatus for folding material according to claim 9, wherein of the gripper means are attached to and movable with respective ones of said flap means.

11. Apparatus for folding material to be packaged comprising:

a plurality of folding flap means, folding flap moving means for sequentially moving said flap means to effect folding of material placed on said flap means, gripper means associated with at least one of said flap means, said gripper means being movable between a gripping position corresponding to gripping of material against a respective flap means and a non-gripping position, and gripper control means for controlling movement of said gripper means between said gripping and non-gripping positions during folding of material by said flap means and flap moving means, wherein said flap means includes:

a plurality of transverse folding flap means for sequentially imparting transverse folds to material placed thereon, and longitudinal folding flap means at opposite longitudinal edges of said transverse folding flap means for imparting longitudinal folds to said material, wherein gripper means are provided at opposite longitudinal edges of at least one of said transverse flap means, and wherein said longitudinal folding flap means include recesses through which the gripper means at said transverse flap means can extend.

12. Apparatus for folding material according to claim 11, wherein said gripper means are resilient and are curved in a C-shaped configuration in a finger-like manner.

13. Apparatus for folding material according to claim 12, wherein said gripper means are attached to gripper support shafts, and wherein said gripper support shafts are attached to and movable with respective ones of said flap means.

14. Apparatus for folding material to be packaged comprising:

a plurality of folding flap means, folding flap moving means for sequentially moving said flap means to effect folding of material placed on said flap means, gripper means associated with at least one of said flap means, said gripper means being movable between a gripping position corresponding to gripping of material against a respective flap means and a non-gripping position, and gripper control means for controlling movement of said gripper means between said gripping and non-gripping positions during folding of material by said flap means and flap moving means, wherein said gripper control means includes flexible shafts attached to and rotatable with each of said gripper support shafts, and wherein said gripper control means includes, for each gripper support shaft:

two cam disks, rotating means for rotating said cam disks, two pendulum levers, a rotary lever pivotally mounted at a fixed axle and having rotation imparting surface means at one end thereof spaced from said fixed axle, and a rotatable member attached to said flexible shaft and engageable with said rotation imparting surface means so as to rotate the flexible shaft in response to movement of said rotary lever, said pendulum levers being engageable with respective ones of said cam disks as well as with said rotary lever such that, during rotation of said cam disks, said pendulum levers transmit motion to said rotary lever.

15. Apparatus for folding material according to claim 14, wherein said rotation imparting surface means is a toothed segment and said rotatable member is a toothed pinion.

16. Apparatus for folding material to be packaged comprising:

a plurality of folding flap means, folding flap moving means for sequentially moving said flap means to effect folding of material placed on said flap means, gripper means associated with at least one of said flap means, said gripper means being movable between a gripping position corresponding to gripping of material against a respective flap means and a non-gripping position, and gripper control means for controlling movement of said gripper means between said gripping and non-gripping positions during folding of material by said flap means and flap moving means, wherein said gripper means are attached to gripper support shafts, wherein said gripper support shafts are attached to and movable with respective ones of said flap means, and wherein recesses are provided in the folding flap means along the edges thereof which face the respective axes of said gripper support shafts, through which recesses the gripper means can extend.

17. Apparatus for folding material according to claim 16, wherein said gripper control means includes flexible shafts attached to and rotatable with each of said gripper support shafts.

18. Apparatus for folding material to be packaged comprising:

a plurality of folding flap means, folding flap moving means for sequentially moving said flap means to effect folding of material placed on said flap means, gripper means associated with at least one of said flap means, said gripper means being movable between a gripping position corresponding to gripping of material against a respective flap means and a non-gripping position, and wherein said gripper means are particularly adapted for gripping engagement with bulk textile materials, textile materials containing elastic bands, and the like, so as to facilitate folding of such materials, and gripper control means for controlling movement of said gripper means between said gripping and non-gripping positions during folding of material by said flap means and flap moving means, said gripper control means including means for retaining said gripper means in a gripping position during folding movement of an associated flap means, whereby material being folded by said associated flap means is gripped against said associated flap means during folding movement of said associated flap means.

19. Apparatus for folding material according to claim 18, wherein the gripper means are attached to and movable with respective ones of said flap means.

20. Apparatus for folding material according to claim 18, wherein said gripper means are attached to gripper support shafts, and wherein said gripper support shafts are attached to and movable with respective ones of said flap means.

21. A method of folding material particularly bulky textile material and the like, comprising:

placing the material on a plurality of closely adjacent folding flap plates, sequentially moving said folding flap plates to fold said material in a predetermined fold pattern, and selectively gripping and ungripping said material with respect to respective ones of said flap plates during said sequential folding, wherein said step of selectively gripping includes rotating gripper support shafts which are attached to and movable with said flap plates during said sequentially moving, and wherein said step of rotating includes rotating flexible shafts which are attached to respective ones of said support shafts by way of rotatable cam disks which are sequentially rotated in predetermined relationship to movement of the flap plates.

22. Apparatus for folding material to be packaged comprising:

a plurality of folding flap means, folding flap moving means for sequentially moving said flap means to effect folding of material placed on said flap means, gripper means associated with at least one of said flap means, said gripper means being movable between a gripping position corresponding to gripping of material against a respective flap means and a non-gripping position, and gripper control means for controlling movement of said gripper means between said gripping and non-gripping positions during folding of material by said flap means and flap moving means, wherein said gripper means are attached to rotatable gripper support shafts, and wherein said gripper control means includes flexible shafts which are attached to respective ones of said support shafts, and rotatable cam disks which are sequentially rotated in predetermined relationship to movement of the flap means, said cam disks being drivingly connected to said flexible shafts for imparting rotation to same.

23. Apparatus for folding material according to claim 22, wherein said folding flap moving means includes automatic flap moving means for automatically sequentially moving said flap means to effect folding of material placed on said flap means.

24. Apparatus for folding material according to claim 23, wherein said gripper control means includes means for automatically controlling said movement of said gripper means between said gripping and non-gripping positions during folding of material of said flap means and flap moving means.

* * * * *